US010202234B2

(12) United States Patent
Moon et al.

(10) Patent No.: US 10,202,234 B2
(45) Date of Patent: Feb. 12, 2019

(54) BED LINEN PACKAGING

(71) Applicant: Purple Innovation, LLC, Alpine, UT (US)

(72) Inventors: Shawn David Moon, Cedar Hills, UT (US); Jennifer Jo Goodwin, Salt Lake City, UT (US)

(73) Assignee: Purple Innovation, LLC, Alpine, UT (US)

( * ) Notice: Subject to any disclaimer, the term of this patent is extended or adjusted under 35 U.S.C. 154(b) by 0 days.

(21) Appl. No.: 15/334,093

(22) Filed: Oct. 25, 2016

(65) Prior Publication Data

US 2018/0111749 A1 Apr. 26, 2018

(51) Int. Cl.

| | |
|---|---|
| ***B65D 5/16*** | (2006.01) |
| ***B65D 85/07*** | (2017.01) |
| ***B65D 5/42*** | (2006.01) |
| ***B65D 43/16*** | (2006.01) |
| ***B65D 43/22*** | (2006.01) |
| ***B65D 5/66*** | (2006.01) |
| ***B65D 85/67*** | (2006.01) |

(52) U.S. Cl.

CPC ..... *B65D 85/07* (2018.01); *B65D 5/4204* (2013.01); *B65D 5/66* (2013.01); *B65D 43/16* (2013.01); *B65D 43/22* (2013.01); *B65D 85/67* (2013.01); *B65D 2201/00* (2013.01); *B65D 2313/02* (2013.01); *B65D 2313/04* (2013.01)

(58) Field of Classification Search

CPC ..... B65D 85/16; B65D 5/4204
USPC ..... 206/494
See application file for complete search history.

(56) References Cited

U.S. PATENT DOCUMENTS

| | | | |
|---|---|---|---|
| 2,256,074 | A | 9/1941 | Crebbs |
| 2,874,707 | A | 2/1959 | Koppel |
| 3,087,605 | A | 4/1963 | Kester |
| D313,140 | S | 12/1990 | Johnson |
| D334,502 | S | 4/1993 | Hill |
| D338,796 | S | 8/1993 | Staudinger |

(Continued)

FOREIGN PATENT DOCUMENTS

TW 476342 U 2/2002

OTHER PUBLICATIONS

International Search Report for PCT Application No. PCT/US2017/057210, dated Dec. 22, 2017, 3 pages.

(Continued)

*Primary Examiner* — King M Chu
(74) *Attorney, Agent, or Firm* — Durham Jones & Pinegar, P.C., Intellectual Property Law Group

(57) ABSTRACT

A packaged bed linen includes a packaging box and at least one bed linen disposed in the packaging box. The packaging box has a back panel, four side panels, a first front panel, and a second front panel attached to one of the side panels. The second front panel is configured to fold relative to a side panel to which it is attached. The first front panel is an interior front panel enclosed within the packaging box when the packaging box is in a closed configuration. The second front panel is an exterior front panel. The exterior front panel includes an exterior side panel configured to lay adjacent a side panel when the packaging box is in the closed configuration, and includes an attachment device securing the exterior side panel to the adjacent side panel in the closed configuration.

20 Claims, 3 Drawing Sheets

(56) References Cited

U.S. PATENT DOCUMENTS

| | | | | |
|---|---|---|---|---|
| D467,117 | S | 12/2002 | Guy | |
| D507,919 | S | 8/2005 | Bishop | |
| D600,549 | S | 9/2009 | Anderson et al. | |
| D602,353 | S | 10/2009 | Anderson et al. | |
| D617,637 | S | 6/2010 | Anderson et al. | |
| D651,891 | S | 1/2012 | Bell | |
| 8,720,718 | B2 * | 5/2014 | Myers | A45C 7/0095 206/577 |
| D774,801 | S | 12/2016 | Clark et al. | |
| D792,124 | S | 7/2017 | Blatt et al. | |
| 9,868,577 | B2 | 1/2018 | Ridgeway | |
| 2008/0164734 | A1 | 7/2008 | Nile et al. | |
| 2008/0264983 | A1 | 10/2008 | Kastan | |
| 2010/0018888 | A1 | 1/2010 | Hamilton | |
| 2010/0213094 | A1 * | 8/2010 | McKay | D06F 89/005 206/494 |
| 2011/0315584 | A1 | 12/2011 | Hofgartner | |
| 2013/0193011 | A1 * | 8/2013 | Scanlan | B65D 85/18 206/281 |
| 2014/0102920 | A1 * | 4/2014 | Kim | B65D 85/182 206/223 |

OTHER PUBLICATIONS

Written Opinion of the International Searching Authority for PCT Application No. PCT/US2017/057210, dated Dec. 22, 2017, 9 pages.

Saferest, Premium Mattress Protector, http://www.saferest.com/premium-mattress-protectors.html, Oct. 25, 2016, 2 pages.

Wamsutta, Dream Zone, Sheet Set, http://www.ebay.com/itm/Wamsutta-Dream-Zone-queen-size-sheet-set-/252599924659?hash=item3ad020f7b3:g:FD0AAOSwImRYDCPc, Oct. 25, 2016, 1 page.

Taiwanese Office Action and Search Report from Taiwanese Application No. 106136732 dated Jun. 8, 2018, 21 pages with English translation.

Introducing Purple Sheets, video dated Dec. 1, 2016, time stamp: 3:36, [online], [site visited Feb. 19, 2018]. Available from Internet, URL: https://www.youtube.com/watch?v=Oec0Xtq06AO (Year: 2016).

* cited by examiner

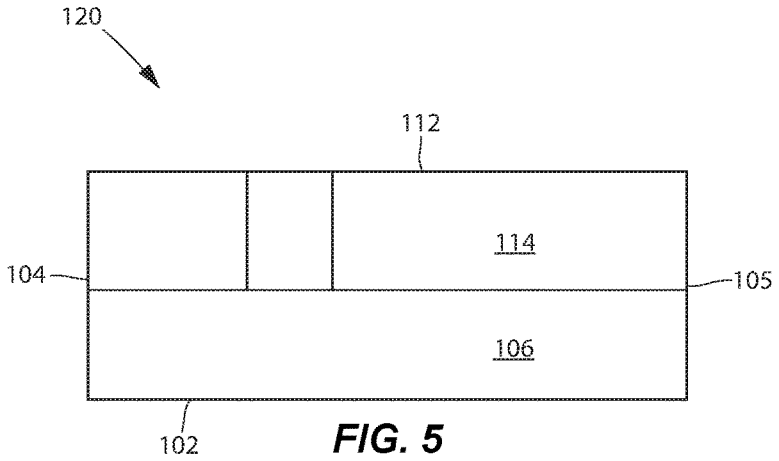
FIG. 5
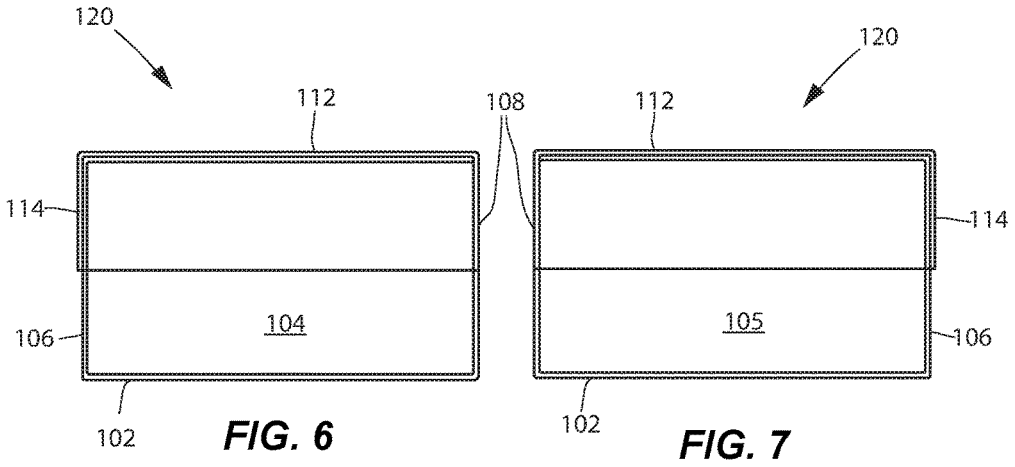
FIG. 6
FIG. 7

BED LINEN PACKAGING

FIELD

Embodiments of the disclosure relate generally to packaging for bed linens, such as fitted sheets, flat sheets, pillow cases, and mattress protectors.

BACKGROUND

Packaging for bed linens, including bed sheets and mattress protectors, commonly consists of a vinyl or vinyl and canvas case that is transparent so as to allow a potential purchaser to view the linens within the packaging. An insert is often included within the package that contains the branding, marketing, and product information thereon.

It is also known to package bed linens in a bag made of the same material constituting the bed linens. Some bed linens have been sold without any packaging other than a band that is wrapped around the folded linen, which includes the branding, marketing, and product information thereon. Bed linens have also been packaged in a standard rectangular cardboard box.

BRIEF SUMMARY

In some embodiments, the present disclosure includes a packaged bed linen. The packaged bed linen comprises at least one bed linen disposed in a packaging box. The packaging box includes a back panel, a top side panel, a bottom side panel, a first lateral side panel, a second lateral side panel, a first front panel, and a second front panel attached at an edge thereof to an edge of one of the first and second lateral side panels and configured to fold relative thereto.

The first front panel may be sized and configured so as to be an interior front panel enclosed within the packaging box when the packaging box is in a closed configuration. The second front panel may be sized and configured so as to be an exterior front panel exposed on the exterior of the packaging box when the packaging box is in the closed configuration. The exterior front panel may further include an exterior side panel configured to lay adjacent one of the first and second lateral side panels when the packaging box is in the closed configuration. The exterior side panel may include at least one attachment device securing the exterior side panel to the adjacent one of the first and second lateral side panels when the packaging box is in the closed configuration.

In additional embodiments, the present disclosure includes methods for packaging a bed linen. In accordance with such a method, a packaging box may be formed that includes a back panel, a top side panel, a bottom side panel, a first lateral side panel, a second lateral side panel, a first front panel, and a second front panel attached at an edge thereof to an edge of one of the first and second lateral side panels and configured to fold relative thereto. The first front panel may be sized and configured so as to be an interior front panel enclosed within the packaging box when the packaging box is in a closed configuration. The second front panel may be sized and configured so as to be an exterior front panel exposed on the exterior of the packaging box when the packaging box is in the closed configuration. The exterior front panel may further include an exterior side panel configured to lay adjacent one of the first and second lateral side panels when the packaging box is in the closed configuration. The exterior side panel includes at least one attachment device securing the exterior side panel to the adjacent one of the first and second lateral side panels when the packaging box is in the closed configuration.

After forming the packaging box, at least one bed linen may be disposed in a space defined by the back panel, the top side panel, the bottom side panel, the first lateral side panel, and the second lateral side panel of the packaging box. The interior front panel then may be positioned so as to at least partially cover the at least one bed linen within the packaging box. The exterior front panel may be folded relative to the one of the first and second lateral side panels to which it is attached, such that the exterior front panel is disposed adjacent the interior front panel, and the exterior side panel may be folded relative to the exterior front panel, and the exterior side panel may be secured to an adjacent one of the first and second lateral side panels.

BRIEF DESCRIPTION OF THE DRAWINGS

While the specification concludes with claims particularly pointing out and distinctly claiming what are regarded as embodiments of the present invention, various features and advantages of embodiments of the disclosure may be more readily ascertained from the following description of example embodiments when read in conjunction with the accompanying drawings, in which:

FIG. 5 is a left side view of the packaged bed linen of FIGS. 3 and 4;

FIG. 6 is a top side view of the packaged bed linen of FIGS. 3-5; and FIG. 7 is a bottom side view of the packaged bed linen of FIGS. 3-6.

DETAILED DESCRIPTION

The illustrations presented herein are not actual views of any particular package, or packaged bed linen, but are merely idealized representations employed to describe embodiments of the present disclosure. Elements common between figures may retain the same numerical designation.

Figure 1:
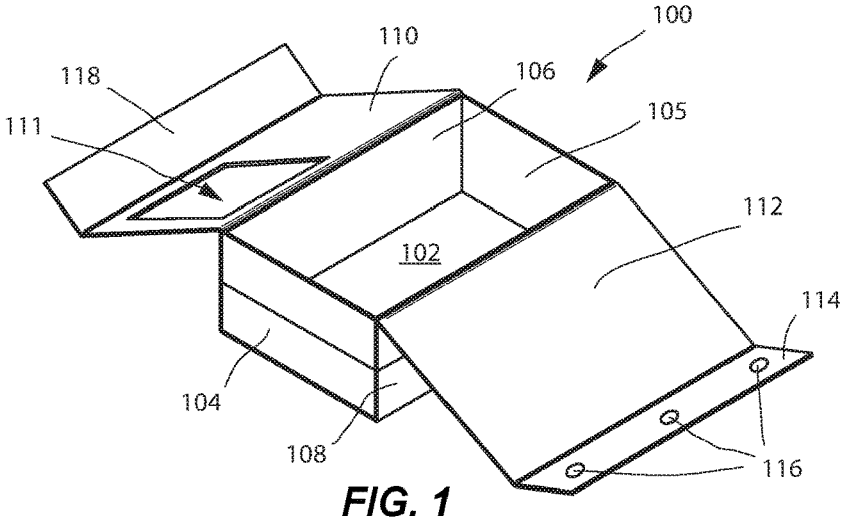
FIG. 1 is a perspective view of an embodiment of a packaging box for bed linens in an open configuration.

FIG. 1 illustrates a packaging box 100. The packaging box 100 includes a back panel 102, a top side panel 104, a bottom side panel 105, a first lateral side panel 106, and a second lateral side panel 108. The packaging box 100 further includes a first front panel 110, which in some embodiments may be attached at an edge thereof to an edge of one of the first and second lateral side panels 106, 108, and a second front panel 112 attached at an edge thereof to an edge of the other of the first and second lateral side panels 106, 108. As a non-limiting example, the first front panel 110 may be attached to the first side panel 106 and the second front panel 112 may be attached to the second side panel 108, as shown in FIG. 1.

In additional embodiments, the first front panel 110 may be a panel that is separate from the other panels of the box 100 and simply disposed therein.

The first and second front panels 110, 112 may be configured to fold relative to the first and second lateral side panels 106, 108 to which they are respectively attached. One of the first and second front panels 110, 112 may be sized and configured so as to be an interior front panel enclosed within the packaging box 100 when the packaging box 100 is in a closed configuration, and the other of the first and second front panels 110, 112 may be sized and configured so as to be an exterior front panel exposed on the exterior of the packaging box 100 when the packaging box 100 is in the closed configuration. For example, in the embodiment shown in FIG. 1, the first front panel 110 is sized and configured so as to be an interior front panel enclosed within the packaging box 100 when the packaging box 100 is in a closed configuration, and the second front panel 112 is sized and configured so as to be an exterior front panel exposed on the exterior of the packaging box 100 when the packaging box 100 is in the closed configuration.

The exterior front panel 112 further includes an exterior side panel 114 configured to lay adjacent the first lateral side panel 106 when the packaging box 100 is in the closed configuration, as described below with reference to FIGS. 5-7. The exterior side panel 114 includes at least one attachment device 116 securing the exterior side panel 114 to the adjacent first lateral side panel 106 when the packaging box 100 is in the closed configuration, which is shown in FIGS. 3-7.

The various panels of the packaging box 100 may be formed of and comprise a relatively rigid material, such as cardboard, a composite fiberboard material, or a polymeric (e.g., plastic) material. Other relatively rigid materials may also be employed.

Figure 2A:
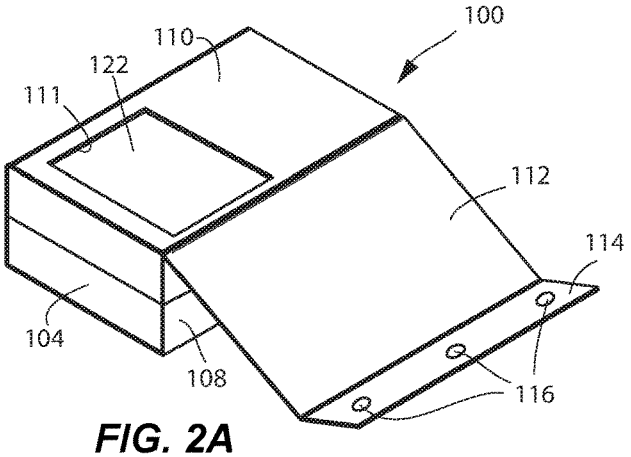
FIGS. 2A and 2B are perspective views of the packaging box of FIG. 1 with a bed linen inside the box and an interior front panel folded over the bed linen, with an exterior front panel in an open configuration.
Figure 2B:
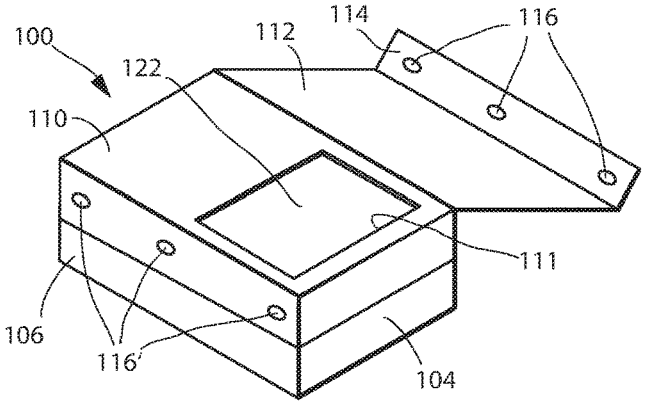
Figure 3:
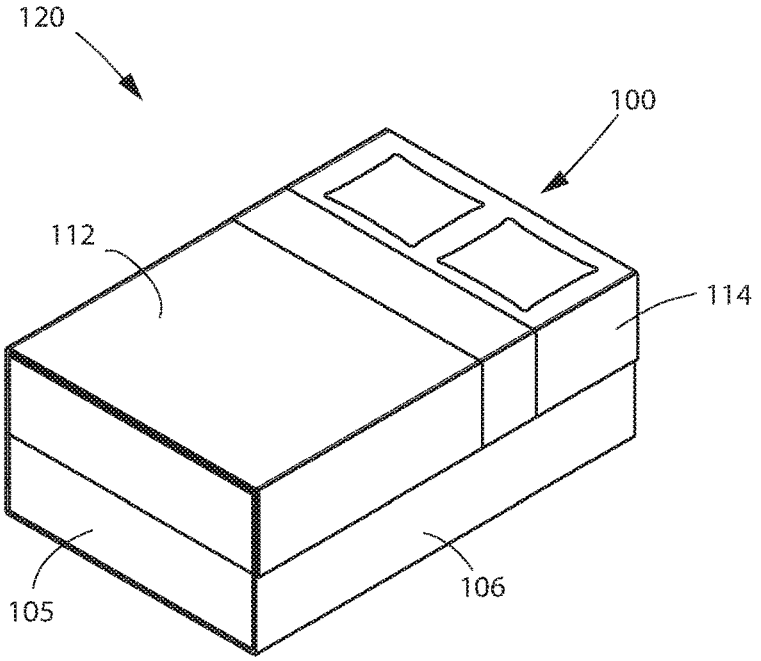
FIG. 3 is a perspective view of a packaged bed linen including a bed linen within the packaging box of FIGS. 1, 2A, and 2B, the packaging box being in a closed configuration.
Figure 4:
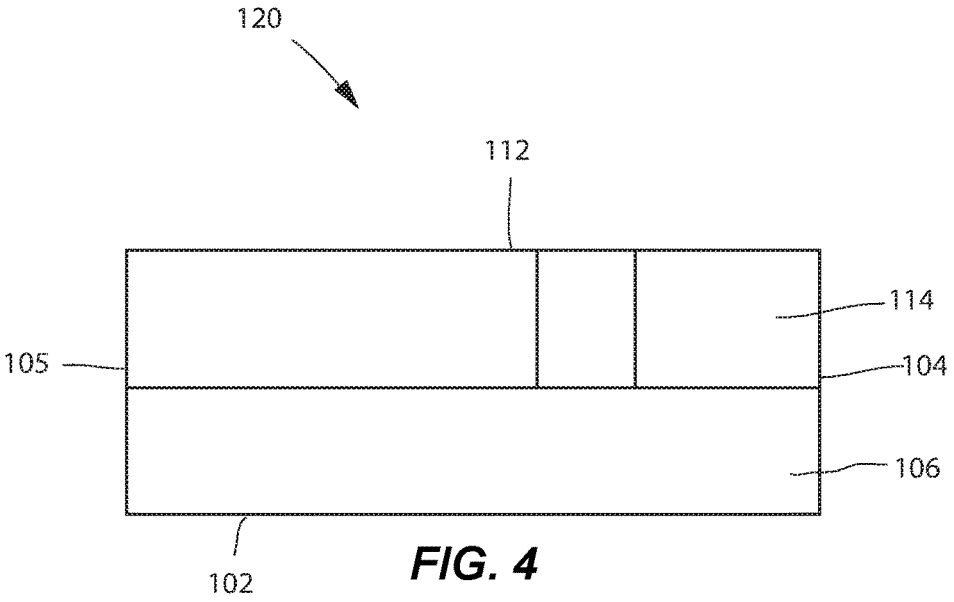
FIG. 4 is a right side view of the packaged bed linen of FIG. 3.

In some embodiments, a plurality of additional attachment devices 116' may be disposed on or in the first lateral side panel 106 as shown in FIG. 2B, and the attachment devices 116 and the additional attachment devices 116' may be complementary to one another and configured to bond or attach together when brought into proximity to one another.

As a non-limiting example, the attachment devices 116 and/or the additional attachment devices 116' may comprise permanent magnets. For example, the attachment devices 116 and the additional attachment devices 116' may comprise permanent magnets. As another example, the attachment devices 116 may comprise permanent magnets, and the additional attachment devices 116' may comprise a ferrous material or another material to which a magnet is attracted. In yet further embodiments, the attachment devices 116 may comprise a ferrous material or another material to which a magnet is attracted, and the additional attachment devices 116' may comprise permanent magnets. In such embodiments, magnetic forces between the attachment devices 116 and the additional attachment devices 116' may hold the exterior side panel 114 against the first lateral side panel 106 when the box 100 is in the closed configuration of FIGS. 3-7.

In other embodiments, a hook-and-loop material (e.g., VELCRO®) may be used to secure the exterior side panel 114 against the first lateral side panel 106 when the box 100 is in the closed configuration. For example, the attachment devices 116 may comprise one component of hook-and-loop material (e.g., hook material), and the additional attachment devices 116' may comprise another component of the hook-and-loop material (e.g., loop material). The components of hook-and-loop material may be located and configured to be attached to one another when the packaging box 100 is in the closed configuration.

In yet further embodiments, snap fasteners may be used to secure the exterior side panel 114 against the first lateral side panel 106 when the box 100 is in the closed configuration. For example, each of the attachment devices 116 may comprise one component of a snap faster, and each of the additional attachment devices 116' may comprise another component of a snap fastener. The components of the snap fasteners may be located and configured to be attached to one another when the packaging box 100 is in the closed configuration.

Any other type of fastener or fastening material may be employed as the attachment devices 116 and/or the additional attachment devices 116'. Furthermore, although three (3) attachment devices 116 and three (3) additional attachment devices 116' are illustrated in the figures, any number (e.g., 0, 1, 2, 4, etc.) of attachment devices 116 and/or additional attachment devices 116' may be employed in other embodiments of the present disclosure.

The exterior front panel 112, exterior side panel 114, and the attachment devices 116, 116' help in maintaining a clean look and feel and hold the exterior front panel 112 secure so the package 100 is not damaged in transit, but also allow the customer to easily access a sample area of the package 100 where they can experience a bed linen product contained therein, which is an important experience when buying bed linens.

In some embodiments, the interior first front panel 110 may include an interior side panel 118, which may be folded relative to the interior first front panel 110 and disposed within the box 100 adjacent the second lateral side panel 108. The interior side panel 118 may help to keep the bed linen 122 securely in place within the box 100 under the interior front panel 110.

As shown in FIGS. 1, 2A, and 2B, the interior front panel 110 may include an aperture 111 extending therethrough so as to enable a person to touch a fabric of the bed linen 122 through the interior front panel 110. This allows a potential customer to feel the fabric of the bed linen 122 in a store prior to purchasing the packaged bed linen 120, and without completely opening or damaging the packaging box 100. Optionally, comparative samples of fabric of other competitive bed linens may also be included so as to allow a potential customer to compare the fabric of the bed linen 122 to the fabric of other competitive and commercially available bed linens.

In other embodiments, the interior front panel 110 may not include such an aperture 111. In such embodiments, a sample of fabric that is identical to a fabric of the bed linen 122 may be secured to an exterior surface of the interior front panel 110, and/or to an interior surface of the exterior front panel 112 so as to allow a potential purchaser to open the exterior front panel 112 and feel the fabric sample without completely opening or damaging the packaging box 100. The fabric sample may take the form of a sample swatch or swatches of fabric that are securely adhered or fastened to the relatively rigid material of the interior front panel 110 and/or exterior front panel 110.

The bed linen 122 may comprise one or more of a flat bed sheet, a fitted bed sheet, a pillowcase, or a mattress protector. In some non-limiting embodiments, the bed linen 122 may be a set of bed sheets consisting of a flat bed sheet, a fitted bed sheet, and one or two pillowcases. In other non-limiting embodiments, the bed linen 122 may be a single mattress protector.

A packaged bed linen 120 may be formed by placing a bed linen 122 within the packaging box 100, and folding the interior first front panel 110 over the bed linen 122 to form the structure shown in FIGS. 2A and 2B, and then folding the exterior front panel 112 over the interior front panel 110 to form the packaged bed linen 120 shown in FIGS. 3-7. More particularly, a packaging box 100 may be formed as described above. After forming the packaging box 100, at least one bed linen 122 may be disposed in a space defined by the back panel 102, the top side panel 104, the bottom side panel 105, the first lateral side panel 106, and the second lateral side panel 108 of the packaging box 100. The interior front panel 110 then may be folded relative to the first lateral side panel 106 to which it is attached, such that the interior front panel 110 at least partially covers the bed linen 122 within the packaging box 100. The exterior front panel 112 then may be folded relative to the second side panel 108 to which it is attached, such that the exterior front panel 112 is disposed adjacent the interior front panel 110. The exterior side panel 114 may be folded relative to the exterior front panel 112, and the exterior side panel 114 may be secured to the adjacent first lateral side panel 106.

The double-fold front provided by the interior front panel 110 and the exterior front panel 112 protects the bed linen 122 and/or sample fabric material, but also gives the manufacturer more space for branding, marketing, and product information, and also enables a sensory experience of the product at the same time. The exterior front panel 112 includes the exterior side panel 114, which extends partway down the lateral side panel 106 to close the box 100. When the exterior front panel 112 is opened, the interior front panel 110 is revealed underneath, which exposes the additional space for branding, marketing, and product information and allows a potential purchaser to feel the bed linen 122 or a sample of bed linen fabric.

Embodiments of the disclosure are susceptible to various modifications and alternative forms. Specific embodiments have been shown in the drawings and described in detail herein to provide illustrative examples of embodiments of the disclosure. However, the disclosure is not limited to the particular forms disclosed herein. Rather, embodiments of the disclosure may include all modifications, equivalents, and alternatives falling within the scope of the disclosure as broadly defined herein. Furthermore, elements and features described herein in relation to some embodiments may be implemented in other embodiments of the disclosure, and may be combined with elements and features described herein in relation to other embodiments to provide yet further embodiments of the disclosure.

What is claimed is:

1. A packaged bed linen, comprising:

a packaging box including:

a back panel;

a top side panel;

a bottom side panel;

a first lateral side panel;

a second lateral side panel;

a first front panel; and a second front panel attached at an edge thereof to an edge of one of the first and second lateral side panels and configured to fold relative thereto;

wherein the first front panel is sized and configured so as to be an interior front panel enclosed within the packaging box when the packaging box is in a closed configuration, the interior front panel comprising an interior side panel configured to lay adjacent to an interior side of one of the first and second lateral side panels when the packaging box is in the closed configuration, the second front panel is sized and configured so as to be an exterior front panel exposed on the exterior of the packaging box when the packaging box is in the closed configuration, the exterior front panel further including an exterior side panel configured to lay adjacent one of the first and second lateral side panels when the packaging box is in the closed configuration, the exterior side panel including at least one attachment device securing the exterior side panel to the adjacent one of the first and second lateral side panels when the packaging box is in the closed configuration; and at least one bed linen disposed in the packaging box.

2. The packaged bed linen of claim 1, wherein the adjacent one of the first and second lateral side panels comprises at least one additional attachment device located and configured to be attracted or coupled to the at least one attachment device of the exterior side panel when the packaging box is in the closed configuration.

3. The packaged bed linen of claim 2, wherein at least one of the at least one attachment device or the at least one additional attachment device comprises a permanent magnet.

4. The packaged bed linen of claim 2, wherein the at least one attachment device comprises one component of hook-and-loop material, and wherein the at least one additional attachment device comprises another component of hook-and-loop material, the components of hook-and-loop material located and configured to be attached to one another when the packaging box is in the closed configuration.

5. The packaged bed linen of claim 2, wherein the at least one attachment device comprises one component of a snap fastener, and wherein the at least one additional attachment device comprises another component of the snap fastener, the components of the snap fastener located and configured to be secured to one another when the packaging box is in the closed configuration.

6. The packaged bed linen of claim 1, wherein the interior front panel has an aperture extending therethrough so as to enable a person to touch a fabric of the at least one bed linen through the interior front panel.

7. The packaged bed linen of claim 1, further comprising a sample of fabric identical to a fabric of the at least one bed linen secured to an exterior surface of the interior front panel or on an interior surface of the exterior front panel.

8. The packaged bed linen of claim 1, wherein the at least one bed linen comprises at least one of a flat bed sheet, a fitted bed sheet, a pillowcase, or a mattress protector.

9. The packaged bed linen of claim 1, wherein the at least one bed linen consists of a flat bed sheet, a fitted bed sheet, and one or two pillowcases.

10. The packaged bed linen of claim 1, wherein the at least one bed linen consists of a mattress protector.

11. A packaged bed linen, comprising:

a packaging box including:

a rectangular container;

a first front panel attached to an upper edge of a first lateral side of the rectangular container; and a second front panel attached to an upper edge of a second opposite lateral side of the rectangular container and comprising an exterior side panel configured to lay adjacent to the first lateral side of the rectangular container when the packaging box is in a closed configuration, the exterior side panel including at least one attachment device securing the exterior side panel to the first lateral side of the rectangular container;

wherein the first front panel is sized and configured to fold behind the second front panel when the packaging box is in the closed configuration, and wherein the second front panel is sized and configured to fold in front of the first front panel and to be exposed on the exterior of the packaging box when the packaging box is in the closed configuration; and at least one bed linen disposed in the packaging box.

12. The packaged bed linen of claim 11, wherein the first lateral of the rectangular container comprises at least one additional attachment device located and configured to couple to the at least one attachment device of the exterior side panel when the packaging box is in the closed configuration.

13. The packaged bed linen of claim 12, wherein at least one of the at least one attachment device or the at least one additional attachment device comprises a permanent magnet.

14. The packaged bed linen of claim 12, wherein the at least one attachment device comprises one component of hook-and-loop material, and wherein the at least one additional attachment device comprises another component of hook-and-loop material.

15. The packaged bed linen of claim 12, wherein the at least one attachment device comprises one component of a snap fastener, and wherein the at least one additional attachment device comprises another component of the snap fastener.

16. The packaged bed linen of claim 11, wherein the first front panel has an aperture extending therethrough so as to enable a person to touch a fabric of the at least one bed linen through the first front panel.

17. The packaged bed linen of claim 11, further comprising a sample of fabric identical to a fabric of the at least one bed linen secured to an exterior surface of the first front panel.

18. The packaged bed linen of claim 11, wherein the first front panel further comprises an interior side panel configured to lay adjacent an interior side of second lateral side of the rectangular container when the packaging box is in the closed configuration.

19. A packaged bed linen, comprising:

a packaging box including:

a rectangular container having a first lateral side and a second opposite lateral side;

a first front panel attached to an upper edge of the first lateral side of the rectangular container, the first front panel sized and configured so as to be an interior front panel enclosed within the packaging box when the packaging box is in a closed configuration and so as to extend from the first lateral side to the second opposite lateral side of the rectangular container; and a second front panel attached to an upper edge of the second opposite lateral side of the rectangular container and comprising an exterior side panel configured to lay adjacent to the first lateral side of the rectangular container when the packaging box is in the closed configuration; and at least one bed linen disposed in the packaging box.

20. The packaged bed linen of claim 19, wherein the first front panel further comprises an interior side panel configured to lay adjacent to an interior side of one of the first and second lateral side panels when the packaging box is in the closed configuration.

* * * * *